US005869422A

United States Patent [19]

Kazumi et al.

[11] Patent Number: 5,869,422

[45] Date of Patent: Feb. 9, 1999

[54] REVERSIBLE THERMOSENSITIVE RECORDING MEDIUM AND METHOD FOR PRODUCING THE MEDIUM

[75] Inventors: Suzuki Kazumi, Shimizu-machi; Yoshihiko Hotta, Mishima; Atsushi Kutami, Numazu; Kunichika Morohoshi, Numazu; Tetsuya Amano, Numazu; Toru Nogiwa, Numazu, all of Japan

[73] Assignee: Ricoh Company, Ltd., Tokyo, Japan

[21] Appl. No.: 683,243

[22] Filed: Jul. 18, 1996

[30] Foreign Application Priority Data

Jul. 19, 1995 [JP] Japan ..... 7-206647

[51] Int. Cl.[6] ..... B41M 5/36

[52] U.S. Cl. ..... 503/207; 503/201; 503/214; 503/226

[58] Field of Search ..... 427/150–152; 503/201, 206, 214, 226, 207

[56] References Cited

U.S. PATENT DOCUMENTS 5,258,350 11/1993 Inoue et al. ..... 503/204

*Primary Examiner*—Bruce H. Hess

*Attorney, Agent, or Firm*—Oblon, Spivak, McClelland, Maier & Neustadt, P.C.

[57] ABSTRACT

A reversible thermosensitive recording medium having a supporting substrate and a reversible thermosensitive recording layer formed on the supporting substrate, having the ratio, of two values of light intensity scattered by the recording layer at large angles and small angles, of more than or equal to two, the ratio of the two numbers of particles of low-molecular-weight organic material with the large size to small size, of more than or equal to 2%, and the ratio of the two numbers of the particles with the small size to the total particles, of more than or equal to 10%, is provided which has improved display quality and excellent durability for repeated recording and erasing cycles over an extended period of time.

32 Claims, 3 Drawing Sheets

REVERSIBLE THERMOSENSITIVE RECORDING MEDIUM AND METHOD FOR PRODUCING THE MEDIUM

BACKGROUND OF THE INVENTION

1. Field of the Invention

The present invention relates to a reversible thermosensitive recording medium. Preferably, the invention recording medium is capable of recording and erasing images repeatedly by reversibly changing between a transparent state and an opaque state by changing the temperature of the recording medium. This invention also relates to a method for producing the medium.

2. Discussion of the Art

A variety of information recording media have been developed to comply with the demands for expanding and diversifying the volume of the information recorded and yet conserving resources and reducing environmental problems. Reversible thermosensitive recording media have been attracting much attention recently over other recording media, due to advantages such as the reversible temporary recording of image information and erasing the information on demand at relatively low cost without complicated developing steps.

As conventional examples of reversible thermosensitive recording media, there is known a recording medium in which a low-molecular-weight organic material such as a higher fatty acid is dispersed in a matrix resin such as vinylchloride-vinylacetate copolymer with a relatively low glass transition temperature, ranging from approximately 50° C. to less than 80° C. (Japanese Laid-Open Patent Applications 54-119377 and 55-154198).

There is also known a reversible thermosensitive recording medium containing a low-molecular-weight organic material with its concentration increased in the direction of the thickness towards a supporting substrate of the medium (Japanese Laid-Open Patent Application H5-8538).

In order to extend the temperature range of the transparent state, a reversible thermosensitive recording medium is disclosed, having a periodic structure of the particles of a low-molecular-weight organic material, which are dispersed in the form of discrete domains in the matrix resin and constituting a phase separation structure with a periodic distance of 1.5 microns or more in Japanese Laid-Open Patent Application H6-72032.

However, display quality in its opaque state and durability of high quality image formation for repeated cycles of the reversible thermosensitive recording media were still insufficient from practical point of view.

SUMMARY OF THE INVENTION

Accordingly, one object of the present invention is to provide a reversible thermosensitive recording medium which overcomes the above-noted difficulties.

A further object of the present invention is to provide a reversible thermosensitive recording medium with improved image visibility in the opaque state and excellent durability of high quality images for repeated recording and erasing cycles over an extended period of time.

These and other objects of the present invention have been provided by the discovery of a reversible thermosensitive recording medium, comprising a supporting substrate and a reversible thermosensitive recording layer disposed thereon, wherein the reversible thermosensitive recording layer comprises a resin matrix and a low-molecular-weight organic material, the recording layer having a ratio of light intensity values scattered by the recording layer at large and small angles of greater than or equal to two, wherein each of the light intensity values at large and small angles is the average of eleven scattering angle intensity values measured at one degree intervals from 70 degrees to 80 degrees of the scattering angle for the large angle and from 40 degrees to 50 degrees for the small angle, and the scattering angle is the angle between the direction of light detection and the direction parallel to the surface of the medium.

According to another embodiment, the invention reversible thermosensitive recording layer has a ratio of large and small particles of the low-molecular-weight organic material of greater than or equal to 0.02 and may also have a ratio of the two numbers of particles of specified small size and the total number of particles of greater than or equal to 0.10, the specified large and small size being more than 1 micron and from 0.3 to 0.6 micron, respectively.

These and other objects, features and advantages of the present invention will become apparent upon a consideration of the following description of the preferred embodiments of the invention taken in conjunction with the accompanying drawings.

DESCRIPTION OF THE PREFERRED EMBODIMENTS

Figure 1:
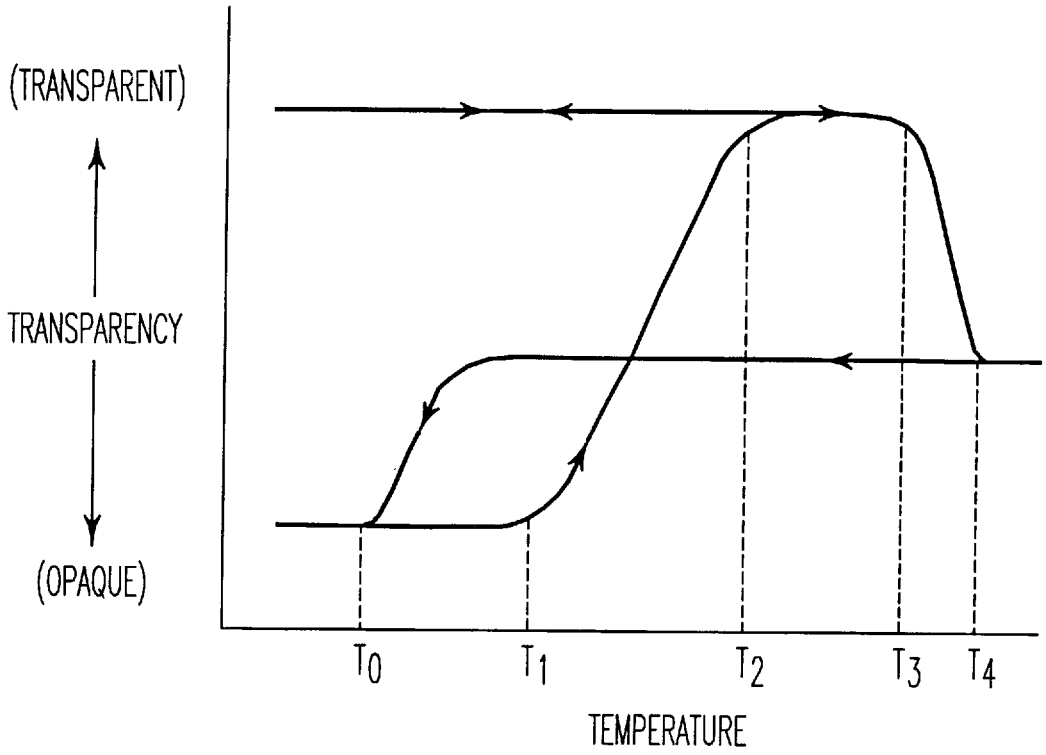
FIG. 1 is a graph showing the relationship between transparency and temperature related to an image recording and erasure cycle of a reversible thermosensitive recording medium of the present invention.

In the detailed description which follows, specific embodiments of the invention particularly useful in the image recording applications are described. It is understood, however, that the invention is not limited to these embodiments. For example, it is appreciated that the recording media and methods of the invention are adaptable to any form of information imaging. Other embodiments will be apparent to those skilled in the art upon reading the following description.

The invention provides a reversible thermosensitive recording medium, comprising a supporting substrate and a reversible thermosensitive recording layer disposed on the supporting substrate, where the reversible thermosensitive recording layer comprises a resin matrix and a low-molecular-weight organic material. In the present invention, the reversible thermosensitive recording layer has a ratio, of the two values of light intensity scattered by the recording layer at large angles and small angles, of greater than or equal to two, wherein each of the light intensity values at large angles and small angles is obtained as the average of eleven scattering angle intensity values measured in one degree intervals starting from 70 degrees and proceeding to 80 degrees for the large angles and starting from 40 degrees and proceeding to 50 degrees for the small angles, respectively, where the scattering angle is the angle between the direction of the light detection and the direction parallel to the surface of the medium. For the purposes of these measurements light impinges on the medium normal to the surface of the medium. See FIG. 2.

The invention reversible thermosensitive recording medium having the present reversible thermosensitive recording layer provides improved display quality in its opaque state and excellent high quality image durability providing repeated recording and erasing cycles over an extended period of time.

The reversible thermosensitive recording medium of the present invention can reversibly be switched between a transparent state and a milky white opaque state, depending on the temperature of the medium. The differences between these states, while not wishing to be held to a theory, are believed to be explained as follows:

(1) In the transparent state, particles of the low-molecular-weight organic material are dispersed in the resin matrix with only a few vacant spaces or voids between the molecule and the matrix resin, with no voids inside the particles. Light beams entering the medium from one side can, therefore, transmit to the other side of the medium without a significant amount of scattering, resulting in a transparent appearance of the medium.

(2) In the milky white state or opaque state, hereinafter referred to as opaque state, the particles of the low-molecular-weight organic material are in a polycrystalline form composed of numerous minute crystals and there exist numerous minute voids at the boundary between these particles and the resin matrix. In this state, the light entering the medium undergoes a large amount of refraction and/or scattering by the voids. As a result, the reversible thermosensitive recording medium becomes opaque and takes on a milky white color in white light.

The transition among the states with temperature of the reversible thermosensitive recording medium will now be described with reference to FIG. 1.

For purposes of illustration, an invention recording medium comprising a low-molecular-weight organic material dispersed in a resin matrix is assumed to be initially at a temperature in range III, at $T_0$ or below, and the medium is in an opaque state here as above-mentioned. When the medium is heated, the transmittance of the light starts from a temperature approximately $T_1$ and reaches its maximum at the temperature of the range I between $T_2$ and $T_3$.

If this medium, which is previously heated and transparent, is cooled down to temperature To or below, the maximum transparency is retained. This is believed to be attributed to the following factors: (1) From the above-mentioned temperature $T_1$, the resin matrix starts in a softened state and as the softening proceeds, the matrix contracts to result in the reduction of voids between the matrix resin and the low-molecular-weight organic material and/or voids inside the particles. The transparency of the medium, therefore, gradually increases and, in the range I, the low-molecular-weight organic material becomes half melted and fills up the remaining voids, resulting in homogeneity of the medium structure and thereby in the maximum transparency. (2) When the low-molecular-weight organic material is cooled down from the half melted state with some seed crystals contained inside, the low-molecular-weight organic material crystallizes at relatively high temperatures and, at that temperature, the matrix resin is still soft enough to follow the volume change induced by the crystallization of the low-molecular-weight organic material, preventing additional void formation and thus maintaining the transparent state.

However, when the medium is further heated to a temperature in range II, between $T_3$ and $T_4$, an intermediate state of the medium results between the maximum transparent state and the opaque state. When the recording medium in this intermediate state is then cooled down, the medium is observed to return to the original opaque state without going through the transparent state. This is thought to be because, after the low-molecular-weight organic material is completely melted at a range II temperature, the low-molecular-weight organic material becomes supercooled and crystallizes at a temperature slightly higher than $T_0$, and at that temperature, the matrix resin has already started to solidify and is not able to follow the volume change induced by the crystallization of the low-molecular-weight organic material, resulting in the formation of voids and thereby the opaque state.

It should be noted that, although there is illustrated one of typical examples and the transmittance versus temperature characteristics in FIG. 1, different characteristics may emerge depending on the type of low-molecular-weight organic material and resin material, and the way which they are combined, for example.

In other words, since the reversible recording process of the present invention is based on the change in transparent and opaque state in the recording material utilizing characteristics such as transmittance and scattering of the light, as above-noted, the void formation and its effect on the light transmittance and scattering is in general largely affected by the structure and distribution of both the low-molecular-weight organic material and the matrix resin in the recording medium.

Figure 2:
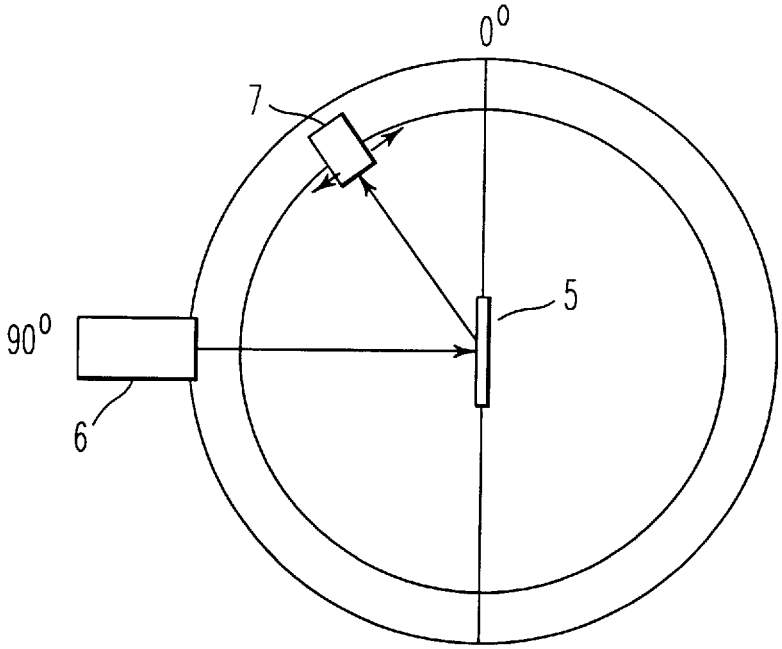
FIG. 2 is a schematic view showing the light scattering measurement method.

Light intensity scattered by the reversible thermosensitive recording medium of the present invention is measured with a DDC-80 dispersion color densitometer(from Nihon Densoku Co) as follows. As shown in FIG. 2, a recording medium 5 is placed inside of, and at the center of, a light shielded enclosure. Approximately parallel light beams from the light source 6 illuminates the medium incident normal to the surface plane of the medium. A photodetector 7 is provided to measure the intensity of scattered light by changing the angle between the direction of light detection and the direction parallel to the plane of the recording medium, the angle being recorded as 0 degree for the direction of light detection parallel to the medium plane and 90 degree for normal to the medium plane, respectively. For the measurement, the intensity zero was specified by interrupting the light beams completely from the detector and maximum intensity for each medium was taken as 100 for each measurement.

The reversible thermosensitive recording medium undergoes changes among states (transparent, intermediate and opaque) with temperature, as afore-mentioned. It is important, therefore, in which state the light scattering from the sample medium should be measured to fully characterize the recording medium. In the recording layer, neither a significant number of voids exist to cause the light scattering in the transparent state, nor the void formation is quite completed in the intermediate state. In the opaque state, by contrast, the recording layer is assumed to appropriately include voids in the layer. Therefore, mostly the recording layer mostly in the opaque state is subjected to the light scattering measurements.

Figure 3A:
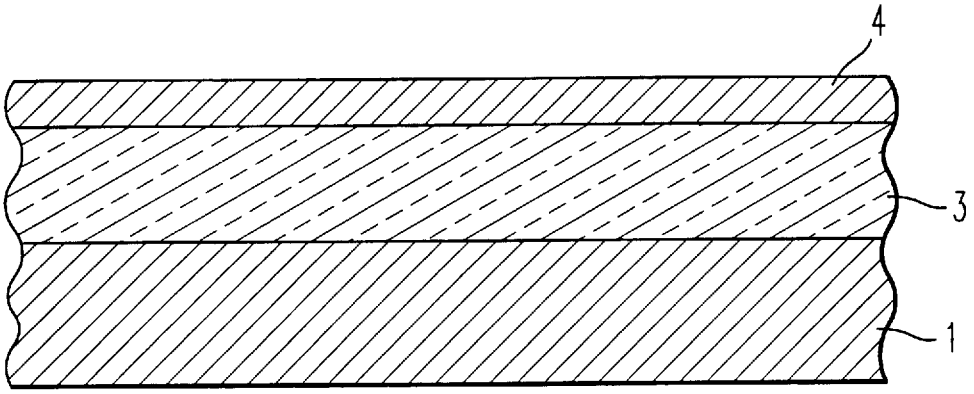
FIG. 3*a* and 3*b* show partially schematic cross-sectional views of reversible thermosensitive recording media of the present invention.
Figure 3B:
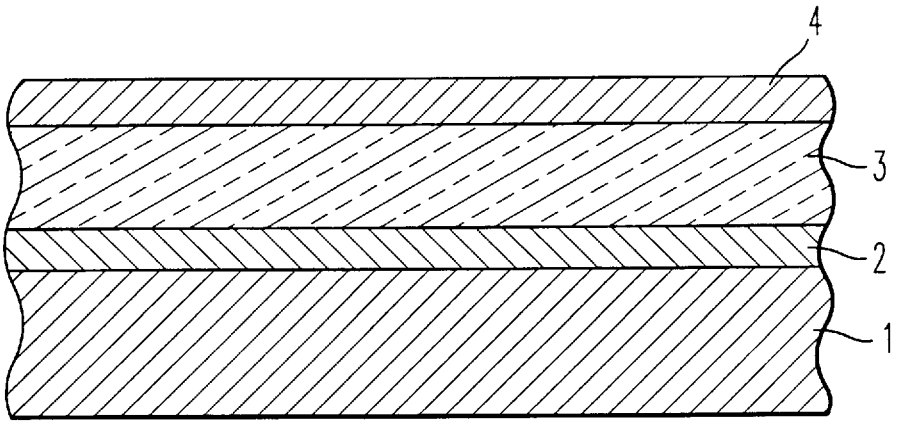

Measurements were carried out for several configurations of the medium. The recording layer 3 shown in FIGS. 3(*a*)

and 3(*b*) is measured as prepared, when the layer is previously formed (1) on a reflecting supporting substrate 1 such as metal plate or (2) on a supporting substrate 1 with a light reflecting layer 2, consisting of aluminum, nickel or tin, for example, interposed between the supporting substrate 1 and the recording layer 3 as shown in FIG. 3(*b*) (see Japanese Laid-Open Pat. Application No. 64-14079 incorporated herein by reference). There are also shown protective layers 4 in the FIGS. 3(*a*) and 3(*b*).

When the recording medium is formed on a transparent supporting substrate, a light reflecting plate is placed behind the supporting substrate opposite to the recording layer, the plate being made of transparent polyethylene telephthalate, for example, backcoated with aluminum. When a supporting substrate was colored, the measurement was carried out on a recording layer, as prepared, without any additional reflection plate.

The light scattering intensity versus scattering angle characteristics is observed as above and the characteristic scattering angles observed are the manifestation of the structure of the recording layer.

Scattered light at large scattering angles is indicative of relatively large periodic distance of the structure of the recording layer, resulting in the scattering of light of relatively long wavelength in the visible wavelength region. The large periodic distance above-noted is considered to indicate that, with the progress of the separation between the low-molecular-weight organic material and matrix resin, relatively little low-molecular-weight organic material remains in the resin, resulting in a higher softening temperature of the resin. This also indicates that less light scattering arises because of the decrease in the number of low-molecular-weight organic material particles in the light path, which may decrease the scattering light intensity, and thereby decrease the image display characteristics, such as the display intensity.

By contrast, light scattered at small scattering angles is considered to be indicative of relatively small periodic distance of the structure of the layer, resulting in the scattering of light of shorter wavelength. The small periodic distance is considered to indicate that a larger amount of low-molecular-weight organic material is present along the light path in the medium, resulting in a larger amount of light scattering. The small periodic distance, however, also indicates that the medium may decrease the display intensity or display contrast, or may change its appearance of whiteness, caused by the increase of scattering of shorter wavelength light including ultraviolet light. This also indicates that the separation between low-molecular-weight organic material and matrix resin is not so advanced in this case and more low-molecular-weight organic material is included in the resin, resulting in a decrease in softening temperature of the resin matrix.

When the relative intensity of light scattered with small scattering angles to large scattering angles is large, more shorter wavelength light in the visible wavelength region is scattered, resulting in the display appearance of the medium in transparent pale bluish white. By contrast, when the relative intensity of light scattered of small scattering angles to that of large scattering angles is small, longer wavelength light is scattered, resulting in the medium appearance of pale yellowish white with higher display quality.

Accordingly, by apropriately mixing several periodic distances in the medium structure, rather than a uniform distance throughout the medium, the light of shorter wavelength and longer wavelength are scattered over the entire visible wavelength range, resulting in improved milky whiteness and excellent display quality.

In addition, when the relative intensity of light scattered at large scattering angles to small scattering angles is small, the separation between low-molecular-weight organic material and matrix resin is not so advanced and more low-molecular-weight organic material is included in the resin. This results in a decrease in the softening temperature of the resin matrix, as above-mentioned, and the whiteness tends to decrease with time, even at, or in the vicinity of, room temperature.

However, in the case where the relative intensity of light scattered at large scattering angles to that of small scattering angle is large, by contrast, the separation between low-molecular-weight organic material and matrix resin is well advanced and less low-molecular-weight organic material are included in the resin. This results in an increase in the softening temperature of the resin matrix and the whiteness hardly changes at, or in the vicinity of, room temperature and, as above-mentioned, an improvement in the display appearance can also be achieved.

The aforementioned light intensity scattered at small scattering angles is obtained as the average of eleven intensity values measured by one degree intervals starting from 40 degrees and proceeding to 50 degrees of the scattering angle. The intensity at large scattering angles is the average similarly obtained for the angle of from 70 degrees to 80 degrees.

According to the present invention, the intensity ratio of the large angles to the small angles is preferably more than or equal to two. For the ratio of more than or equal to three, a more preferable result is obtained with improved display quality and an excellent durability.

Microscopic structure of the recording layer is examined as follows with a transmission electron microscope. The layer was first stained by exposing to osmium oxide vapor for about 12 hours, fixed with a two-liquid type epoxy resin (from Sony Chemical Co), and sliced with an RMC MT6000-XL microtome to prepare films with the thickness of from 1000 to 1300 A. The films are observed and photographed with a transmission electron microscope H-500H from Hitachi Co, and the size and the number in unit area, of the particles of the low-molecular-weight organic material are obtained from the photographs by the electron microscope.

The relationship between the periodic distance of the structure of the recording layer and the display quality and image durability was previously detailed. Here is described the relationship between the particle size and the above-noted two properties. In principle, it is considered that as the periodic distance becomes smaller, the particle size becomes smaller, and vice versa.

The relative abundance in the small particles is considered to indicate that the separation between the low-molecular-weight organic material and matrix resin is not very advanced and a large number of the low-molecular-weight organic material are included in the matrix resin, resulting in lower softening temperature of the resin matrix. This also indicates that the temperature difference is small between the crystallization of the low-molecular-weight organic material and softening of the resin matrix, resulting in mostly minute voids. These minute voids contribute mostly to the scattering of the light of shorter wavelength in the visible region.

By contrast, when large particles are relatively abundant, the separation between the low-molecular-weight organic material and matrix resin is considered to be advanced and fewer number of low-molecular-weight organic material are included in the resin, resulting in higher softening temperature of the resin matrix.

This indicates that the temperature difference is larger between crystallization of the low-molecular-weight organic material and softening of the resin, resulting in larger voids. These large voids contribute mostly to the light scattering of relatively long wavelength.

In case of relative abundance in small particles, more low-molecular-weight organic material are included in the resin and the softening temperature of the resin matrix decreases. The display appearance is transparent pale bluish white of insufficient display quality, and the whiteness tends to decrease with time even at, or in the vicinity of, room temperature. By contrast, in case of relative abundance in large particles, the display appearance is pale reddish white, with also insufficient display quality.

Accordingly, by appropriately mixing the particles of small and large size, display appearance of pale yellowish whiteness can be achieved. Also with large particles, the separation between low-molecular-weight organic material and matrix resin is well advanced and the softening temperature of the resin increases and the whiteness hardly changes at, or in the vicinity of, room temperature, thereby achieving desirable characteristics for the image display.

According to the present invention, the small size particles above-mentioned are preferably from 0.3 to 0.6 microns in diameter and the large size are preferably more than or equal to one micron. The ratio, of the two numbers of the particles of the low-molecular-weight organic material with the large size and the small size, (# of large particles/# of small particles is preferably greater than or equal to 0.02 and also has a ratio, of the two numbers of the particles of the small size to total particles (# of small particles/# of total particles), of more than equal to 0.1, resulting in a better display quality and display image durability. Also the ratio, of the two numbers of the particles, of the small size and total particle is preferably less than or equal to 0.3, and is more preferably less than or equal to 0.25.

The method of manufacturing the reversible thermosensitive recording medium is detailed as follows.

Among various parameters of the medium, the particle size is of primary importance. The particle size can be increased by heating the medium to a temperature high enough to thoroughly soften the matrix resin and to completely melt the low-molecular-weight organic material. Without such heating, the size is small and periodic distance is generally short. When heated, the low-molecular-weight organic material is considered to be able to move with relative ease in the matrix resin to become aggregated into a large particles of the low-molecular-weight organic material and, at the same time, the separation of the low-molecular-weight organic material from the matrix resin into which the low-molecular-weight organic material was previously melted is also considered to take place.

In the case of vinyl chloride-vinyl acetate copolymer conventionally used as the matrix resin, the movement of the low-molecular-weight organic material in the resin is limited because of its relatively low degree of softness even at temperature above the softening temperature. Therefore, the above-mentioned aggregation is difficult to take place and this copolymer is not satisfactory for the use of the reversible thermosensitive recording medium.

In the present invention, this disadvantage was obviated by the discovery of resin materials more suitable for the reversible thermosensitive recording medium. By utilizing the resins with lower softening and degree of softening higher than the above-mentioned vinyl chloride-vinylacetate copolymer, the movement and aggregation of the low-molecular-weight organic material become less limited, enabling to provide more suitable medium in the present invention.

When the above-mentioned materials and the method are employed, the separation between the low-molecular-weight organic material and matrix resin takes place with more ease to form particles of various sizes. As the softening temperature of the resin is higher, the minute and movable low-molecular-weight organic material particles separate from the resin and aggregate with nearby and relatively large particles, under the influence of strong cohesive force, to form large particles.

The low-molecular-weight organic material of medium size, by contrast, aggregates to form small size particles, retaining approximately same size, under the cohesive force of moderate magnitude.

Although the vinyl chloride-vinyl acetate copolymer has a lower degree of softness, as aforementioned, this copolymer can be used for the reversible thermosensitive recording medium by rendering to have lower softening temperature.

The property of the matrix resin may also be improved by crosslinking resins, following to the particle formation, by heat,ultraviolet light or electron beam. Because of crosslinks formed in the matrix resin, a desirable property results such that the distribution of the low-molecular-weight organic material in the resin matrix does not change so much by repeated application of heat and/or pressure, thus realizing excellent durability for repeated recording and erasing cycles over an extended period of time.

Temperature range suitable for the particle can be selected in such a manner that the matrix resin is completely softened and the low-molecular-weight organic material are thoroughly melted at that temperature. The particle size can be controlled by adjusting heating time length.

The change in transparency of the reversible thermosensitive recording layer is considered to be closely related to the softening temperature and deformation of the layer above the softening temperature. In order to improve the erasing speed, therefore, it is important to elucidate how the erasing speed is affected by the temperature range of the transparency, which is described below, and by the speed of the deformation of the recording layer.

The transparency of the recording layer is initiated by the softening of matrix resin. When heating time for the reversible thermosensitive recording layer can be selected relatively long, tranparency initiation temperature generally becomes low. By contrast, when the heating time is limited to be short, the initiation temperature has to be higher. Therefore, if the transparency initiation temperature stays relatively constant with the change of heating time period, the matrix can be softened in a relatively short heating time, followed by a fast decrease in the amount of voids by the matrix deformation. This results in desirable characteristics for the reversible thermosensitive recording medium from practical point of view such as, for example, a speedy attainment of transparency or image erasure even at low temperatures.

Accordingly, the rate of the change in transparency initiation temperature with heating time is a parameter of practical importance.

In the present invention, the above rate of the change in transparency initiation temperature with heating time period is preferably less than or equal to 13%, more preferably less than or equal to 10%, and further preferably less than or equal to 6%.

The measurements of the rate of the change in transparency initiation temperature with heating time are carried out as follows with a Heat Gradient Tester HGB-100 from Toyo-Seiki Seisakusho Co.

The apparatus is adjusted to 60 seconds as a print time and 1 kg/cm$^2$ as a printing pressure. A recording medium at the opaque state is heated to a temperature of 50° C. and maintained for 60 seconds and then cool down to room temperature for a first measurement. For subsequent measurements, temperature is adjusted with the increment of one degree added to the previous setting and the heating time and the cooling process are repeated as the same as the starting conditions. After each heat treatment, the sample medium is subjected to reflection density measurements using a reflective densitometer MacBeth RD-914. As the basis of optical density value, the value 0.2 is taken for the present measurements, which is described below. When an observed value of reflection density exceeds the value 0.2 at a temperature, the temperature is recorded as the transparency initiating temperature for the 60 second heating $T_{60s}$ for the recording layer.

The above-mentioned base optical density is the value obtained as the average of the reflection intensity values observed at 10 locations on the sample medium, which is previously heated to achieve the maximum transparency.

Subsequently, the print timer setting of the apparatus is switched to one second and heat treatment and measurement are carried out in a similar manner as describes as above and its characteristic temperature is obtained as $T_{1s}$.

Using the values $T_{60s}$ and $T_{1s}$ obtained above, the rate of the change in the transparency initiation temperature with heating time is calculated from the relation, $$\text{rate}(\%)=[(|T_{1s}-T_{60s}|)/T_{60s}]\times 100.$$

In case where the transparent state can not be achieved by the above conditions, different temperature and/or pressure may be selected for the heat treatment. In addition, the method of evaluation test above-noted is applicable to (1) a recording layer and also (2) a recording layer with a protective layer additionally provided thereon.

As above indicated, the change from the opaque state to the transparent state in the reversible thermosensitive recording medium results from the decrease in the number of the voids following to softening and contraction of the resin matrix. It is noteworthy the actual occurrence of the transparency within short heating time as much as several milliseconds indicates that the speed of the softening or deformation of the resin is considerably high, contributing to short image erasing time.

In the reversible thermosensitive recording medium of the present invention, the low-molecular-weight organic material is dispersed in the matrix resin. It is preferable to employ such resin matrix that can form a reversible thermosensitive recording layer in the form of film, and impart high transparency and mechanical stability for the recording layer.

Specific examples of the resin useful for the matrix of the present invention include, alone or in any combination or mixture, polyvinyl chloride; vinyl chloride copolymers such as vinyl chloride-vinyl acetate copolymer, vinyl chloride-vinyl acetate-vinyl alcohol copolymer, vinyl chloride-vinyl acetate-maleic acid copolymer, vinyl chloride-acrylate copolymer, vinyl chloride-vinyl ester of fatty acid (with three or more carbon atoms) copolymer and vinyl chloride-ethylene copolymer; vinylidene chloride copolymers such as polyvinylidene chloride, vinylidene chloride-vinyl chloride copolymer and vinylidene chloride-acrylonitrile copolymer; polymethylmethacrylate and methacrylate copolymer.

As the matrix resin to impart higher speed image erasing, resins with long side chains and/or resins with compounds of low softening temperature can be employed in the invention. The side chain of the above-mentioned compounds is preferably of more than or equal to three carbons in the alkyl radical basis, and may include ether bond or ester bond in the chain and also carboxyl radical or hydroxy radical at the end of the chain. Specific examples of the main chain of the compounds include; polyvinylchloride, polycarbonate, phenoxy resin, polystyrene, chlorinated polyvinylchloride and copolymer thereof.

The fatty acid, which constitutes the ester for the vinyl chloride-vinyl ester copolymer of the present invention, has three or more carbon atoms, that is, the acid being higher than, or inclusive of, propionic acid.

Specific examples of the vinyl chloride-vinyl ester copolymer according to the present invention include but not limited to:

vinylchloride-vinylpropionate copolymer,
vinylchloride-vinylbutyrate copolymer,
vinylchloride-vinylvalerate copolymer,
vinylchloride-vinylcapronate copolymer,
vinylchloride-vinylenanthate copolymer,
vinylchloride-vinylcaprylate copolymer,
vinylchloride-vinylpelargonate copolymer,
vinylchloride-vinylcaprate copolymer,
vinylchloride-vinylundecante copolymer,
vinylchloride-vinyllaurate copolymer,
vinylchloride-vinyltridecylate copolymer,
vinylchloride-vinylmyristate copolymer,
vinylchloride-vinylpentadecylate copolymer,
vinylchloride-vinylpalmitate copolymer,
vinylchloride-vinylmargarate copolymer,
vinylchloride-vinylstearate copolymer,
vinylchloride-vinylnonadecanate copolymer,
vinylchloride-vinylarachate copolymer,
vinylchloride-vinylbehenate copolymer,
vinylchloride-vinyllignocerate copolymer,
vinylchloride-vinylcerotate copolymer,
vinylchloride--vinylmontanate copolymer, and
vinylchloride-vinylmelissate copolymer.

The above-noted vinylester may have the chain structure of, either normal or branched. Specific examples of the vinyl esters include but are not limited to:

vinylchloride-vinylisopropyonate copolymer,
vinylchloride-vinylisobutyrate copolymer,
vinylchloride-vinylisovalerate copolymer, and
vinylchloride-vinylisocapronate copolymer.

The copolymerizaton ratio, of vinyl chloride unit to vinyl ester unit, of the copolymers are preferably from 99/11 to 20/80 in weight. The average degree of polymerization P is preferably more than or equal to 100, and more preferably more than or equal to 200, and further preferably more than or equal to 300.

The ethylene content in the vinylchloride-ethylene copolymer employed in the present invention is preferably more than or equal to 1%, more preferably more than or equal to 2% and further preferably more than or equal to 4%.

Since the softening temperature decreases as the ethylene content increases, a relatively high ethylene content is preferred in the present invention. The average degree of polymerization is preferably more than or equal to 200, more preferably more than or equal to 300 and further preferably more than or equal to 400.

In addition to the above-mentioned resins, the vinyl chloride-vinyl ether copolymer is included as resin with low softening temperature and its general formula is shown below where m and n denote repeat units and have values of 1 or above. The vinyl alkyl ether of the copolymer preferably has three or more carbon atoms.

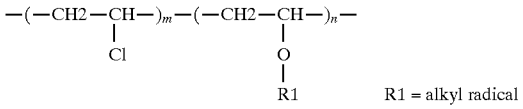

The above-noted resins can be employed individually or in combination and these resins are employed in combination with the resin of the formula.

These resins may be used in the present invention with at least one of, or in combination with one or more other resins, such as saturated polyester, polyethylene, polypropylene, polystyrene, polymethacrylate, polyamide, polyvinylpyrrolidone, natural rubber, polyacrolein, or polycarbonate and copolymer thereof.

In addition, there are also employed polyacrylate, polyacryloamide, polysiloxane, polyvinyl alcohol or copolymer thereof.

The highest glass transition temperature Tg of the resins for the resin matrix in the present invention is preferably less than 100° C., more preferably less than 90° C., further preferably less than 80° C. Also the lowest glass transition temperature is preferably 40° C. or more, more preferably 50° C. or more and further preferably 60° C. or more.

The low molecular weight organic material for use in the ♂ reversible thermosensitive recording layer according to the present invention may appropriately be selected from materials which can disperse in the layer as particles and also have a melting point ranging from 30° C. to 200° C., more preferably from 50° C. to 150° C.

Examples of low-molecular-weight organic materials useful alone or in any mixture or combination for the present invention include, but are not limited to alkanols; alkane diols; halogenated alkanols or halogenated alkane diols; alkylamines; alkanes; alkenes; alkynes; halogenated alkanes; halogenated alkenes; halogenated alkynes; cycloalkanes; cycloalkenes; cycloalkynes; saturated or unsaturated monocarboxylic acids, or saturated or unsaturated dicarboxylic acids, or esters amides and ammonium salts thereof; saturated or unsaturated halogenated fatty acids, and esters, amides and ammonium salts thereof; arylcarboxylic acids, and esters, amides and ammonium salts thereof; halogenated arylcarboxylic acids, and esters, amides and ammonium salts thereof; thioalcohols; thiocarboxylic acids, and esters, amides and ammonium salts thereof; and carboxylic acid esters of thioalcohol. These materials may be used individually or in combination.

It is preferable that the number of carbon atoms of the above-mentioned low molecular weight organic material is in the range of 10 to 60, more preferably in the range of 10 to 38, further preferably in the range of 10 to 30. The portion of alcohol groups in the esters may be saturated or unsaturated, and may further be substituted by a halogen. In any of these materials, it is preferable that the low molecular weight organic material has at least one atom selected from the group consisting of oxygen, nitrogen, sulfur and halogen. More specifically, it is preferable that the low molecular weight organic material comprise, for example, —OH, —COOH, —CONH, —COOR, —NH, —NH2, —S—, —S—S—, —O—, or halogen atom.

It is desirable to increase the temperature range in which the reversible thermosensitive recording material is in the transparent state. In order to attain the increase, a low-molecular-weight organic material with a low melting temperature may be used in combination with a low-molecular-weight organic material with a high melting temperature. The difference in the melting temperature of the above-mentioned low-molecular-weight organic materials for use in the resent invention is preferably 20° C. or more, more preferably 30° C. or more, further preferably 40° C. or more.

The melting point of the low-molecular-weight organic material with a low meting point is preferably from 40° C. to 100° C., and more preferably from 50° C. to 80° C.

The melting point of the low-molecular-weight organic material with a high meting point is preferably from 100° C. to 200° C., and more preferably from 110° C. to 180° C.

As the low-molecular-weight organic materials with a low melting temperature preferably employed in the present invention include of fatty acid ester, dibasic acid ester and ester of polyhydric alcohol and dibasic acid, which are described below. The low-molecular-weight organic materials are employed individually or in combination with one or more of the materials.

The fatty acid ester appropriately selected for use in the present invention is characterized such that the melting temperature of the above ester is lower than the melting temperature of the fatty acid of the same carbon number in its dimer state, and alternatively, if melting temperatures are same, the carbon number of the ester is larger than that of the fatty acid.

When recording and erasing are repeatedly carried out on the reversible thermosensitive recording medium with a thermal printhead, for example, deterioration in image quality generally results, which are considered to be due to change of distribution of the particles of low-molecular-weight organic material dissolved in the resin matrix.

Since the solubility of the low-molecular-weight organic material in the resin decreases with increasing carbon number of the organic material, the deterioration of the image formation is assumed to decreases with the increase of the carbon number. The degree of milky whiteness also tends to increase with the increase of the carbon number.

The transparency temperature of a low-molecular-weight organic material is generally close to the melting temperature of the material. Accordingly, by the use of fatty acid ester in place of the fatty acid itself, a higher degree of the milky whiteness, higher display contrast and, in addition, a higher durability in the repeated image recording are expected.

Moreover, by the use of fatty acid ester in combination with low-molecular-weight organic material of high melting temperature, further improvement is realized such as: (1) increase in the transparency temperature, (2) higher image erasing efficiency with thermal printhead, which secures erasing performance even for recording media with the quality somewhat altered by a prolonged storage, for example, and (3) a higher durability for repeated image formation.

Fatty acid esters for use in the present invention are expressed by the following general formula:

$$R_1—COO—R_2 \quad (I),$$

where $R_1$ and $R_2$ are alkyl radicals of carbon number of 10 or more.

The carbon number of the fatty acid esters are preferably 20 or more, more preferably 25 or more, further preferably 30 or more. As the carbon number increases the medium has a characteristics that the milky whiteness of the medium increases. The melting point of the fatty acid ester is preferably 40° C. or more. One or more of the esters are selected for use in the present invention.

Specific examples of the fatty acid esters for use in the present invention include octadecyl palmitate, dococyl palmitate, heptyl stearate, octyl stearate, octadecyl stearate, dococyl stearate, octadecyl behenate, and dococyl behenate.

Dibasic acid esters may possibly be either monoester or diester, which are expressed by the following general formula, $$ROOC—(CH_2)_n—COOR' \quad (II),$$

where R and R' are constituted by hydrogen atom or alkyl radical of carbon atoms of from 1 to 30, and R and R' are either the same or different each other, in exclusive of being hydrogen at the same time and also the number n is an integer of from 0 to 40.

In the dicarboxylic aliphatic acid ester, expressed by the general formula(II) above, the carbon numbers of the alkyl radicals R and R' are preferably an integer from 1 to 30 and n is an integer of preferably from 1 to 30 and more preferably from 2 to 20. The melting temperature of the ester is preferably 40° C. or more.

The specific examples of the dicarboxylic aliphatic acid ester include succinic acid ester, adipic acid ester, sebatic acid ester, and 1-(18-)octadecamethylene dicarboxylic acid ester.

The esters of polyhydric alcohol and dibasic aliphatic acid for use as the low-molecular-weight organic material in the present invention are expressed by the following general formula, $$CH3(CH2)_{m-2}COO(CH2)_nOOC(CH2)_{m-2}CH3 \quad (III),$$

where the number n is an integer from 2 to 40, preferably from 3 to 30, and more preferably from 4 to 22, and the number m is also an integer from 2 to 40, preferably from 3 to 30, more preferably from 4 to 22.

The specific example of the esters include:

1,3-propanediole dialkanate, 1,6-hexanediole dialkanate, 1,10-decanediole dialkanate, and 1,18-octadecanediole dialkanate.

As afore-mentioned, ester of polyhydric alcohol and dibasic aliphatic acid use in the present invention is characterized such that the melting temperature of the above ester is lower than the temperature of the fatty acid of the same carbon number, and if melting temperatures are same, the carbon number of the ester is larger than that of the fatty acid.

Deterioration in image quality during the repeated image recording and erasing cycles is considered to be due to change in distribution of the particles of low-molecular-weight organic material dissolved in the resin matrix. Since the solubility of the low-molecular-weight organic material in the resin decreases with increasing carbon number of the low-molecular-weight organic material, the deterioration of the image formation is assumed to decrease with the increase of the carbon number. The degree of milky whiteness also tends to increase with the increase of the carbon number.

Since the transparency temperature of a low-molecular-weight organic material is generally close to the melting temperature of the material, by the use of fatty acid ester in place of the fatty acid itself, a higher degree of the milky whiteness or a higher imaging contrast and, in addition, a higher durability in the repeated image formation are expected.

The ester of polyhydric alcohol and dibasic aliphatic acid has a relatively low melting temperature and also has the same degree of milky whiteness and durability in repeated image formation of the same degree as those exhibited by the fatty acids with higher carbon number. When the ester of polyhydric alcohol and dibasic aliphatic acid are employed in combination with the low-molecular-weight organic material of higher melting temperature to increase the temperature range of the transparency, in addition to maintaining the milky whiteness and the durability of the same degree as those realized by the fatty acid, an increase in the transparency temperature range can be realized. This results in image erasing with more ease in shorter time by means of thermal printhead, for example. In addition, with the increased margin presently obtained for the recording medium, secured erasing with the thermal printhead, for example, can be carried out. This consideration is necessary from practical point of view because fluctuation of energy, required for the erasing process from one medium to another, may arise after a prolonged storage of the recording medium.

Examples of low-molecular-weight organic materials having a high melting temperature for the use in the present invention include but not limited to saturated aliphatic dicarboxylkic acids, ketones with higher alkyl radical, semicarbazone derived from the ketones, and a-phoisphono fatty acid. These are used individually or in combination.

Specific examples of the low-molecular-weight organic material with the melting temperature of 100° C. or more include:

aliphatic dicarboxylic acids with the melting temperature of from 100° C. to 135° C. such as succinic acid, glutaric acid, adipic acid, pimeric acid, suberic acid, azelaic acid, sebasic acid, undecanedionic acid, tetradecanedionic acid, pentadecanedionic acid, hexadecanedionic acid, heptadecanedionic acid, octadecanedionic acid, nonadecanedionic acid, eicosanedionic acid, heneicosanedionic acid, and docosanedionic acid.

The above-mentioned acids are employed individually or in combination.

The ketone for use in the present invention constitute of ketone radicals and higher alkyl radicals as the essential constituting radicals, also include non-substituted or substituted aromatic ring or heterocyclic ring. The carbon number of the ketones above is preferably 16 or more, and more preferably 21 or more. And the semicarbazone in for use in the present invention are derived from the ketones above.

Specific example of the ketones and semicarbazone for use in the present invention include 3-octadecanone, 7-eicosanone, 14-heptacosanone, 18-pentatriacontanone, tetradecanephenone, docosanophenone, docosanonaphthophenone, and 2-heneicosanone semicarbazone.

The α-phosphonofatty acids for use in the present invention can be obtained according to a method described by E. V. Kaurer et al, J. Am. Oil Chemist's Soc. 41, 205 (1964), which follows:

The fatty acids are first bromized by Hell-Volhard-Zelinskin reaction to obtain α-bromofattyacids and ester of (-bromofatty acid by adding ethanol and further α-sulphonofatty acid ester by heating reaction with triethyl phosfite and product of the hydrolysis with chloric acid is recrystallized from toluene to obtain the end compound.

Specific examples of the phosphono acid for use in the present invention include α-phosphonomyristic acid, α-phosphonopalmitic acid, and α-phosphonostearic acid.

The acids other than α-phosphonopelgoic acid have two melting temperatures.

The weight:weight mixing ratio between the above-mentioned low melting temperature low-molecular-weight organic material and the high melting temperature low-molecular-weight organic material is from 95:5 to 5:95 and preferably from 90:10 to 10:90 and more preferably from 80:20 to 20:80.

Further examples of low-molecular-weight organic materials useful for the reversible thermosensitive recording layer in present invention include higher aliphatic acids, such as lauric acid, dodecanic acid, myristic acid, pentadecanic acid, palmitic acid, stearic acid, behenic acid, arachidic acid, and oleic acid.

Examples of low-molecular-weight organic materials also include ether or thioether, such as:

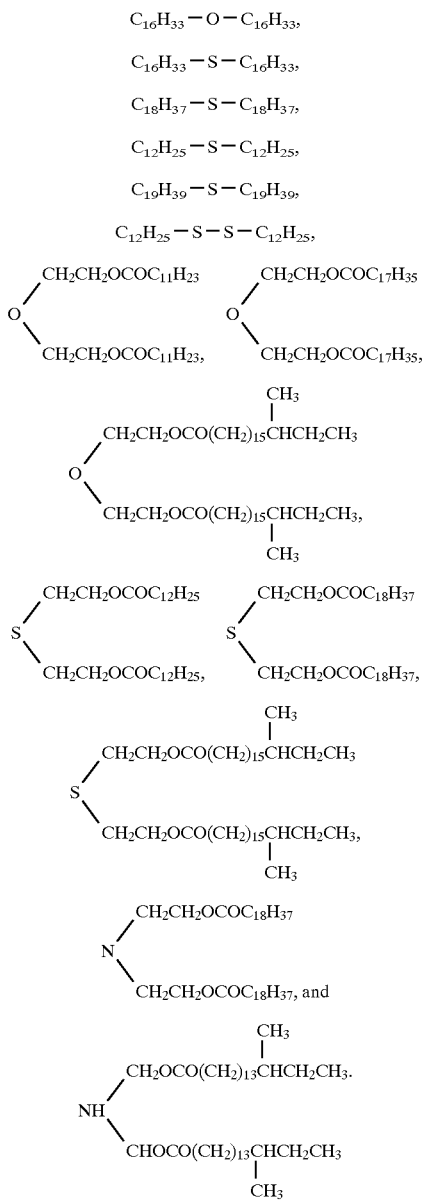

Among the compounds above-mentioned, higher fatty acids especially useful in the present invention include these with carbon atoms of preferably 16 and more and more preferably from 16 to 24, such as palmitic acid, pentadecanic acid, nonadecanic acid, arachidic acid, stearic acid, behenic acid, and glyceric acid.

As aforenoted, the temperature range of the transparency can increase by use of the low-molecular-weight organic material described in the present disclosure in combination with each other, or in combination with other material with different melting temperature. These compounds include but not limited to those disclosed in Japanese Laid-Open Patent Application Nos. 63-39378 and 63-130380 and Japanese Patent Application Nos. 63-14754 and H3-2089.

The weight ratio of the total amount of low-molecular-weight organic material to total amount of matrix resin optionally with cross linking structure is preferably from 2:1 to 1:16 and more preferably from 1:2 to 1:8. For the amount of the resin less than the value above, it becomes difficult to stably include the low-molecular-weight organic material in the resin film and for more amount of resin, by contrast, a sufficient opaqueness can not be achieved because of an insufficient amount of the low-molecular-weight organic material.

In addition to the above-mentioned materials, in order to achieve the transparent image formation with more ease, one or more elastomers and/or one or more surfactants or other additives can be also included in the layer.

As the elastomers useful for the present invention are esters of phosphoric acid, di-fatty acid, phthalic acid, or dihydric acid, glycol elastomers, polyester elastomers, and epoxy elastomers. Useful amounts are 0.01–0.5 g, more preferably 0.03–0.2 g, per g of matrix resin.

Specific examples of the elastomers in the present invention include tributyl phthalate, tri-2-ethylhexyl phthalate, triphenyl phthalate, tricresyl phthalate, butyl oleate, dimethyl phthalate, diethyl phthalate, dibutyl phthalate, diheptyl phthalate, di-n-octyl phthalate, di-2-ethyhexyl phthalate, butylbenzyl phthalate, dibutyl adipate, di-n-hexyl adipate, di-2-ethylhexyl adipate, di-2-ethylhexyl azelate, dibutyl sebacate, di-2-ethylhexyl sebacate, diethyl glycol dibenzoate, triethylene glycol di-2-ethylbutylate, methy acetylricinoleate, butyl acetylricinoleate, butylphtalyl butyl glicolate, and tributyl acetylcitrate.

Specific examples of the surfactant and other additive compounds include:

- pollyhydric alcohol higher acid ester,
- polyhydric alcohol higher alkyl ether,
- higher alcohol,
- higher alkyl phenol,
- higher alkyl amine of higher fatty acid,
- amide of higher fatty acid;
- oil, fat, and lower olefin oxide adducts of polypropylene glycol;
- acetylene glycol;
- sodium, calcium, barium or magnesium salt of higher alkyl benzenesulfonic acid;
- sodium, calcium, barium or magnesium salt of aromatic carboxylic acid, higher aliphatic sulfonic acid, aromatic sulfonic acid, sulfonic monoester, phosphric monoester and phosphoric diester;
- lower sulfated oil;
- long-chain polyalkyl acrylate;
- acrylic oligomer;
- long-chain polyalkyl methacrylate;
- copolymer of long-chain polyalkyl methacrylate and amine-containing monomer;
- styrene-maleic anhydride copolymer; and
- olefin-maleic anhydride copolymer.

Optional crosslinking of the matrix resins may be induced by heat, ultraviolet light or electron beams. Electron beam method is preferred in the present invention, which is described below. Crosslinking is generally carried with the steps of, (1) use of crosslinking resin, (2) addition of crosslinking agents, and (3) irradiating resin material with ultraviolet light or electron beams with the crosslinking agents added.

Examples of crosslinking agents useful in the present invention include but not limited to oligomers of, urethane acrylate, epoxy acrylate, polyester acrylate, polyethter acrylate, vinyl compound, and unsaturated polyester; and monomers of, monofunctional or polyfunctional acrylate, methacrylate, vinylester, styrene derivative, and allyl compound.

Specific examples, of non-functional or functional monomers and oligomers, useful in the present invention include but not limited to:

non-functioal monomers (1) methyl (meth)acrylate (EMA)
(2) ethyl (meth)acrylate (EMA)
(3) n-buthyl (meth)acrylate (BMA)
(4) i-buthyl (meth)acrylate (IBMA)
(5) t-buthyl (meth)acrylate (TBMA)
(6) n-ethyhexyl (meth)acrylate (EHMA)
(7) lauryl (meth)acrylate (LMA)
(8) alkyl (meth)acrylate (SLMA)
(9) tridecyl (meth)acrylate (TDMA)
(10) stearyl (meth)acrylate (SMA)
(11) cyclohexyl (meth)acrylate (CHMA), and
(12) benzyl (meth)acrylate (BZMA)

where methacrylate is preferred monofunctional monomers

(13) methacrylic acid (MAA)
(14) hydroxyethyl (meth)acrylate (HEMA)
(15) hydroxypropyl (meth)acrylate (HPMA)
(16) dimethylaminoethyl (meth)acrylate (DMMA)
(17) chloride salt of dimethylaminoethyl (meth)acrylate (DMCMA)
(18) diethylaminoethyl (meth)acrylate (DEMA)
(19) glycidyl (meth)acrylate (GMA)
(20) tetrahydrofurfuryl (meth)acrylate (THFMA)
(21) allyl (meth)acrylate (AMA)
(22) ethylene glycol dimethacrylate (EDMA)
(23) triethyleneglycol dimethacrylate (3EDMA)
(24) tetraethylene glycol dimethacrylate (4EDMA)
(25) 1,3-butylene glycol dimethacrylate (BDMA)
(26) 1,6-hexanediole dimethacrylate (HXMA)
(27) trimethylolpropane trimethacrylate (TMPMA)
(28) 2-ethoxyethyl methacrylate (ETMA)
(29) 2-ethylhexyl acrylate
(30) phenoxyethyl acrylate
(31) 2-ethoxyethyl acrylate
(32) 2-ethoxyethoxyethyl acrylate
(33) 2-hydroxyethyl acrylate
(34) 2-hydroxypropyl acrylate
(35) dicyclopentenyloxyethyl acrylate
(36) N-vinylpyrolidone
(37) vinylacetate where methacrylate is preferred where possible.

bifunctional monomers

(38) 1,4-butanediol acrylate
(39) 1,6-hexanediol diacrylate
(40) 1,9-nonanediol diacrylate
(41) neopentyl glycol diacrylate
(42) tetraethylene glycol diacrylate
(43) tripropropylene glycol diacrylate
(44) tripropropylene glycol diacrylate
(45) polypropylene glycol diacrylate
(46) (adduct of bisphenol A with ethylene oxide) diacrylate
(47) glycerol methacrylate acrylate
(48) (adduct of neopentylglycol with 2 mols of propylene oxide)diacrylate
(49) diethylene glycol diacrylate
(50) polyethylene glycol(400)diacrylate
(51) neopentyl glycol hydroxypivalate diacrylate
(52) 2,2-bis(4-acryloxydiethoxyphenyl)propane
(53) neopentyl glycol adipate diacrylate

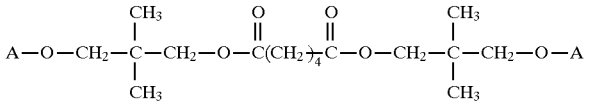

wherein A represents following acryloyl group.

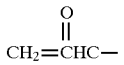

(hereinafter acryloyl group refers to as A)

(54) a compound of (adduct of neopentylglycol hydroxypivalate with ϵ-caprolactone)diacrylate

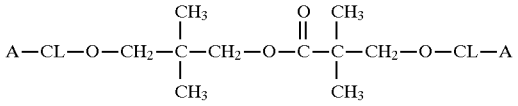

wherein CL represents following ϵ-caprolactonyl group.

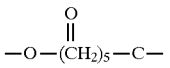

(hereinafter ϵ-caprolactonyl group refers to as CL)

(55) a compound of (adduct of neopentylglycol hydroxypivalate with ϵ-caprolactone)diacrylate

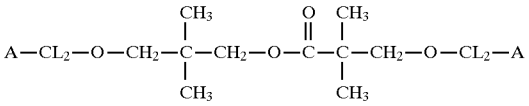

(56) 2-(2-hydroxy-1,1-dimethylethyl)-5-hydroxymethyl-5-ethyl-1,3-dioxane diacrylate

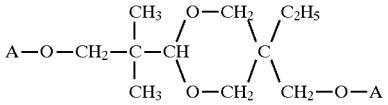

(57) tricyclodecane dimethylol diacrylate

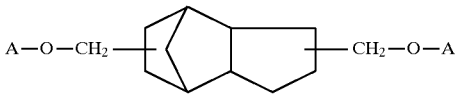

(58) (adduct of tricyclodecane dimethylol with ϵ-caprolactone) diacrylate

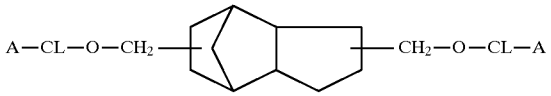

(59) 1,6-hexamethylene diglycidylether diacrylate

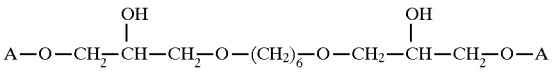

polyfunctional monomer

(60) trimethylolpropane triacrylate

(61) pentaerythritol triacrylate

(62) (adduct of glycerol with polyethylene oxide) triacrylate

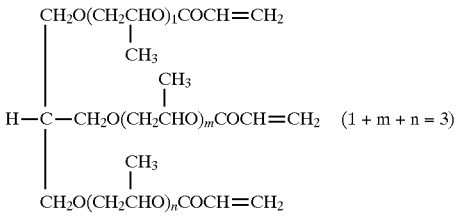

(63) trisacryloyloxyethyl phosphate

(64) pentaerythritol tetraacrylate

(65) (adduct of trimethylolpropane with 3 mols of propyleneoxide)triacrylate

(66) glycerol propoxy triacrylate

(67) dipentaerythritol-polyacrylate

(68) (adduct of dipentaerythritol with ϵ-caprolactone) polyacrylate

(69) dipentaerythritol propionate triacrylate

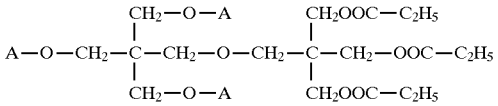

(70) (hydroxypivalic aldehyde modified dimethylol propyne) triacrylate

(71) dipentaerythritol propionate tetraacrylate

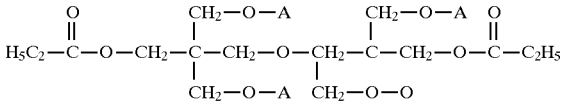

(72) ditrimethylol propane tetraacrylate

(73) dipentaerythritol propionate pentaacrylate

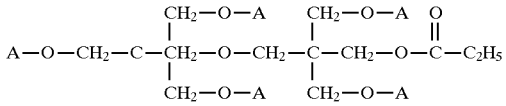

(74) dipentaerythritol hexaacrylate (DPHA)

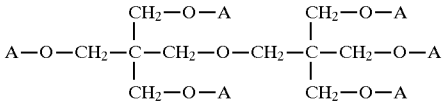

(75) adduct of DPHA with ϵ-caprolactone

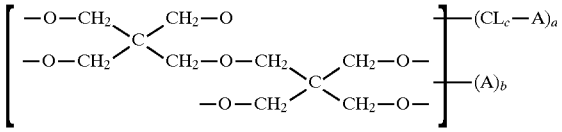

DPCA-20: a=2, b=4, and c=1,

DPCA-30: a=3, b=3, and c=1,

DPCA-60: a=6, and c=1, and

DPCA-120: a=6, and c=2.

oligomer

(76) adduct of bisphenol A with diepoxy acrylic acid

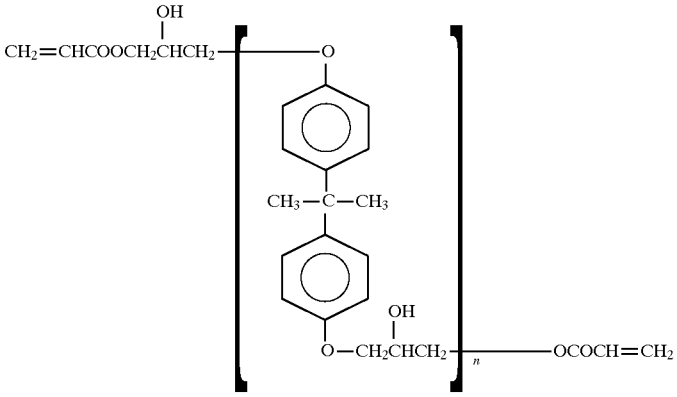

These crosslinking agents are used individually or in combination. The amount of a crosslinking agent to be added is preferably from 0.001 to 1.0 part by weight and more preferably from 0.01 to 0.5 part by weight, to 1 part by weight of the matrix resin. When less than 0.001 part by weight of the agent is added, insufficient results of crosslinking is obtained and, when more than 1.0 part by weight of the agent is added, milky whiteness and display contrast are reduced.

As aforementioned, in order to achieve satisfactory crosslinking efficiency with a minimum amount of the crosslinking agent, functional monomers are preferred to non-functional monomer and polyfunctional monomers are more preferable to monofunctional monomers.

When the crosslinking of the resin materials is carried out under ultraviolet light irradiation, additional materials such as crosslinking agent, photopolymerization initiator, and photopolymerization accelerator are added to the resin.

The crosslinking agents can be divided broadly into two groups, photopolymerizing prepolymers and photopolymerizing monomers. As the latter, monofunctional and polyfunctional monomers used as the cross linking agents for electron beam crosslinking may also be employed. Suitable materials for the former include polyester acrylate, polyurethane acrylate, epoxy acrylate, polyether acrylate, oligo acrylate, alkyd acrylate, and polyole acrylate.

These crosslinking agents can be used singly or in combination. The amount of the crosslinking agents to be added to the resin is preferably from 0.001 to 1.0 part by weight, and more preferably from 0.01 to 0.5 part by weight, to 1 part by weight of the matrix resin. Similarly to the aforementioned electron beam irradiation, insufficient crosslinking results are obtained for the crosslinking agents of less than 0.001 part by weight to 1 part by weight of the resin and milky whiteness and display contrast are reduced for the amount of 1 part or more by weight to 1 part by weight of resin.

The photopolymerization initiator can be divided broadly into two groups, the radical reaction type of initiators and ion reaction type. The former is further divided into the light cleavage type and the hydrogen abstraction type. Suitable examples of the photopolymerization initiators in the present invention include but not limited to:

1. benzoin ether,
   isobutylbenzoin ether,
   isopropylbenzoin ether,
   benzoinethyl ether,
   benzoinmethyl ether,
2. α-acyloxy ester,
   1-phenyl-1,2-propanedione-2-(o-ethoxycarbonyl) oxime,
3. benzylketal,
   2,2-dimethoxy-2-phenylacetophenonebenzyl,
   hydroxycyclohexylphenylketone,
4. acetophenone derivatives,
   dieothoxyacetophenone,
   2-hydroxy-2-methyl-1-phenylpropane-1-one,
5. ketone-(ketone-amine compound),
   benzophenone,
   chlorothioxanthone,
   2-chlorothioxanthone,
   isopropylthioxanthone,
   2-methylthioxanthone, and
   benzophenone substituted with chlorine.

The photopolymerization initiator can be used singly or in combination. The amount of the initiators to be added to the resin is preferably from 0.005 to 1.0 part by weight and more preferably from 0.01 to 0.5 part by weight, to 1 part by weight of the resin.

As the photopolymerization accelerator for use in the present invention, there can be used (1) the hydrogen abstraction type of the accelerator, such as benzophenone and thioxanthone, as above-mentioned, and (2) amine compound, such as aliphatic tertiary amine and aromatic amine, which have the effect of increasing speed of hardening resins.

Specific examples of the amino compounds include isoamyl-P-dimethylaminobenzoate and ethyl-P-dimethylaminobenzoate.

The photopolymerization accelerator can be used singly or in combination with two or more of the accelerators. The amount of the accelerator to be added to resin is preferably from 0.1 to 5 part by weight and more preferably from 0.3 to 3 part by weight, to 1 part by weight of the accelerator.

Ultraviolet light irradiation apparatus generally consists of a light source, an irradiation chamber, a power supply, a cooling system and a conveyor unit. Examples of light sources useful for the irradiation apparatus include a mercury lamp, a metal halide lamp, a gallium lamp, a mercury xenon lamp and a flash lamp. Among these light sources, one with its emission spectrum suitably corresponding to the absorption spectra of the aforementioned initiators and/or accelerators may appropriately be selected for the photopolymerization in the present invention. The irradiation conditions for the crosslinking reaction are determined according to the lamp power and/or conveyor speed, for example.

As one of the irradiation methods suitable for forming the reversible thermosensitive recording layer in the present invention, electron beam irradiation is described which follows.

(1) Electron beam irradiation apparatus is broadly divided into two types, scanning beam type and non-scanning (i.e. area beam) type. An area type of the irradiation apparatus with suitable dose of electron beam is appropriately selected.

(2) Conditions of electron beam irradiation can be determined to achieve the dose required to crosslinking of the resin materials from the following equation:

$$D=(\Delta E/\Delta R)\cdot I\eta/(W\cdot V),$$

where D dose required (M rad),

ΔE/ΔR average energy loss,

ηirradiation efficiency,

I electron beam current (mA),

W irradiation breadth (cm), and

V conveyor speed (cm/sec). For the practical purpose, the relation can be simplified as $D\cdot V=K\cdot I/W$ and the irradiation rating is expressed in terms of Mrad·m/min. Electron beam current conventionally utilized for the irradiation is from 20 to 30 mA for an experimental apparatus, from 50 to 100 mA for a pilot line, and from 100 to 500 mA for manufacturing.

The irradiation dose required for the crosslinking resin materials can be determined by taking the following parameters into consideration, such as (1) the type of the resin to be irradiated and (2) the type and the amount of, the crosslinking agents and the type of and the amount of, the elastomers, which affect the crosslinking efficiency and gel fraction.

In case where electron beams of higher energy is required for the crosslinking resin, the irradiation can be carried out by repeating irradiations with idling periods appropriately intervened in-between. This results in a reduction of the amount of heat generated by each of the irradiations, thereby avoiding the deformation and/or the alteration of the recording layer by heat from the irradiation.

To improve the effect of the irradiation, the recording layer is preferably heated, prior to the electron beam irradiation, to a temperature, at which at least a part of the low-molecular-weight organic material is melted or more preferably all of the organic materials are melted, in the recording medium.

The crosslinking efficiency is affected, as above-mentioned, by parameters such as type of the resin and the degree of polymerization of the resin, and the type of, and the amount of crosslinking agents and elastomers added.

Concerning to the type of the resins, aforementioned resins can be employed. As the degree of polymerization increases, the gel fraction generally increases. Therefore, the degree of polymerization is preferably more than or equal to 300 and more preferably more than or equal to 600 in the present invention.

The type and the amount of the crosslinking agents were detailed previously.

With respect to the type of the elastomers, aforementioned fatty-acid esters, polyester type and epoxy type of elastomers are preferably included as suitable materials in the present invention. The epoxy type elastomers are more preferable from the point of view of less irradiation induced coloring and higher crosslinking efficiency. Since the gel fraction increases with the amount of the elastomers, the amount of the elastomers to be added is preferably from 0.01 to 1.0 part by weight and more preferably from 0.05 to 1.0 part by weight, to 1 part by weight of resin.

In addition to the above-mentioned methods, there are described several methods useful for improving the durability of the recording medium for repeated use for extended period of time.

In the first place, the durability can be increased by increasing the softening temperature of the recording layer. The higher the softening temperature is, the better the reproducibility becomes. For the measurements of softening temperatures, an equipment such as either thermal machine analyzing apparatus (TMA) or dynamic viscoelasticity measurement apparatus can be employed using recording layer samples similar to those used for the gel fraction measurements.

These measurements can be carried out by solid pendulum method or dynamic viscoelasticity measurement without peeling the recording layer off from the supporting substrate.

Secondly, the improvement in the durability can also be achieved by the provision of the aforementioned protective layer on the recording layer, thus strengthening adhesion between the reversible thermosensitive recording layer and the protective layer. The greater the adhesion between these two layers is, the higher the durability becomes. Measurements of the adhesion can be carried out according to the method defined by Tappi (i.e. Technical Association of the Pulp and Paper Industry) UM-403.

The measurement of penetration depht of a TMA needle into the recording layer is useful as one of the other methods of the durability measurement. The smaller the penetration depth is obtained, the higher the durability is expected. The measurement is carried out by measuring the distance of the displacement of the probe needle, when the needle with a small cross-sectional area at its tip portion is placed on the recording layer and loaded with prescribed amount of weight at elevated temperatures, if necessary.

In addition, the lower the residual amount of the crosslinking agents in the recording layer after the crosslinking by electron beam, for example, the durability is found to be higher. The residual amount of the agents can be measured as follows.

Sample recording layers, similar to those used for the aforementioned gel fraction measurements are measured using a Fourier transform infrared spectrometer equipped with an optional ATR (i.e. attenuated total reflection) measurement unit. An infrared absorption band at around 810 cm-1 is known to be attributed to out-of-plane deformation vibration of CH group of acryloyl radical, which is in the residue of the crosslinking agents in the present case. The intensity of the infrared absorption band is also known to be proportional to the number of the acryloyl radicals. By measuring the intensity of the above-mentioned infrared absorption band, therefore, the residual amount of the crosslinking agents can be determined.

In the present invention, the residual amount of the crosslinking agents in the reversible thermosensitive recording layer is 0.2 part by weight or less, preferably 0.1 part by weight or less, more preferably 0.05 part by weight or less and further preferably 0.01 part by weight or less, to 1 part by weight of resin material.

Also by the infrared absorption measurement, the residual amount of other compounds remaining in the recording layer can be obtained, such as photopolymerization initiator and/or accelerator used for the ultraviolet hardening, and catalysts used for the thermal hardening. In addition, by quantitatively analyzing the amount of each of the remaining compounds, there can be determined afterwards which hardening method was utilized, electron beam, ultraviolet light, or thermal method.

In any one of the methods, the fewer the residual amount is, the higher the durability of the recording layer becomes. Since the uppermost portion of the layer with the thickness of the order of several microns can be measured by the above-mentioned infrared absorption method, measurements can be carried out for the recording layer as disposed on the supporting substrate as prepared without any of additional sampling steps.

In addition, the display quality and contrast of the medium in the opaque state can be improved by appropriately including interfaces between the low-molecular-weight organic material and matrix resin, and/or voids in the particles due to the difference in their refractive indices. When the diameter of the voids is more than one tenth of the wavelength of light used for viewing the medium, a desirable effect on the display quality can be achieved.

When the reversible thermosensitive recording medium is used in reflection mode for displaying images, a light reflecting layer may be provided on the back side of the recording layer opposite to the side of light incidence. In this case, a high image contrast can be obtained even for the recording layer of a relatively small thickness. The light reflecting layer may be formed by the deposition of aluminum, nickel, or tin, for example, on the supporting substrate as disclosed in Japanese Laid-Open Patent Application 64-14079.

A protective layer may further be provided on reversible thermosensitive recording layer to protect the recording layer from damage or deterioration. Suitable materials for the protective layer in the present invention include silicone rubber or silicone resin (Japanese Laid-Open Patent Application 63-221087), polysiloxane graft polymer (Japanese Laid-Open Patent Application 62-152550), and ultraviolet curing resin or electron beam hardening resin (Japanese Laid-Open Patent Application 63-310600). The thickness of the protective layer is preferably from 0.1 to 10 microns.

As suitable solvents for preparing coating compositions of the protective layer, those which do not easily dissolve the matrix resin or the low-molecular-weight organic material in the recording layer are used to retain the favorable quality of the present recording layer.

Specific examples of the solvents include n-hexane, methyl alcohol, ethyl alcohol, and isopropyl alcohol. In particular, alcohol based solvents are preferred from the cost point of view.

The protective layer can be hardened at the same time as the crosslinking of the resins of the recording layer. In this case, following to the formation of the recording layer on the supporting substrate, a coating composition of the protective layer is coated, dried, and both of the recording layer and the protective layer are hardened by ultraviolet light or electron beam irradiation according to the above-mentioned conditions. In order to protect the recording layer from solvents or monomer components in the coating composition of the protective layer, an intermediate layer can be interposed between the protective layer and the recording layer, as disclosed in Japanese Laid-Open Patent Application H1-133781.

Suitable materials for use in the intermediate layer include the same resins as used for the matrix in the recording layer and thermoplastic resins such as polyethylene, polypropylene, polystyrene, polyvinyl alcohol, polyvinyl butyral, polyurethane, saturated polyester, epoxy resin, phenolic resin, polycarbonate, and polyamide. The thickness of the intermediate layer is preferably from 0.1 to 2 microns.

To further improve the visual display quality, a colored layer can be provided. The colored layer is formed by coating a coloring composition, or affixing color sheets, on the back side of the recording layer from the direction of light incidence.

The coating composition is prepared by dissolving or dispersing coloring agents and binder resins, into solvents. Suitable examples of coloring agents useful in the present invention include dyes or pigments, in color such as red, yellow, blue, deep blue, violet, black, brown, gray, orange, or green, which are capable of clearly displaying the state change, opaque or transparent, of the overlying recording layer. Suitable examples of binder resins useful in the color layer include conventional thermoplastic resins, thermal hardening or ultraviolet light hardening resins.

A layer of air, which contains air in non-adhered portion between the recording layer and the supporting substrate, can be useful to improve display quality of the recording medium. The improvement is achieved by the relatively large difference between refractive indices, of air and low-molecular-weight organic materials, the refractive index being 1.0 for air and from 1.0 to 1.4 for the organic materials. The resulting light reflection at the interface between these two layers can, therefore, enhance the opaqueness and display visibility.

Since the layer of air, being included in non-adhesive portion, can operate as a thermal insulating layer as well, the thermal resistance of the recording medium can be improved. In addition, the non-adhered portion can act also as an air bumper and relax pressure exerted on the recording layer by a thermal printhead, for example. This has an favorable effect such as reduction of possible deformation by heat of the recording layer and undesirable growth of the particles of the organic materials in the layer, resulting in an improvement of the durability for the repeated use of the recording medium.

On the rear side of the medium, a layer of an adhesive material can be provided for use as data recording labels, for the recording medium itself by being attached to other supporting materials. Examples of such supporting materials include but not limited to a vinylchloride card, such as a credit card, IC card, ID card; paper, film, synthetic paper, boarding pass, and commuting ticket. When the supporting materials have a surface with such poor adhesion as that of aluminum, for example, an adhesive layer can additionally be provided between the supporting material and the recording medium (Japanese Laid-Open Patent Application H3-7377).

Typical examples of image display devices utilizing the reversible thermosensitive recording medium of the present invention include two types of the devices which follow.

The one is the type of which both of the image recording and erasing are carried out by single heating element such as, for example, a thermal printhead with a slightly different energy input to the heating element for each of the recording and erasing process.

The other is the type of which the image recording is made by a thermal printhead as above and, by contrast, the erasing is carried out either by (1) a contact and pressurizing type of the heating element such as a thermal printhead, hot stamp, or heated block, or (2) a non-contact type of heating means such as heated air or infrared radiation.

In the present invention, the low-molecular-weight organic material are embedded in the resin matrix of crosslinked structure. Therefore, the image erasing can be carried out without noticeable strain of the matrix, resulting in excellent erasing capability of the recording medium for repeated use over an extended period of time.

Having generally described this invention, a further understanding can be obtained by reference to certain specific examples which are provided herein for purposes of illustration only and are not intended to be limiting. In the description in the following examples, numerals are in weight ratio unless otherwise indicated.

EXAMPLES

Examples 1

A reversible thermosensitive recording medium of the present invention was fabricated in accordance with steps and apparatus which follow.

Firstly, onto a supporting substrate of transparent polyethyleneterephthalate(PET)film of 188 micron thick (HSL-188 from Teijin Co), a layer of aluminum was deposited with a thickness of 600 A to form a light reflecting layer using a conventional vacuum evaporation apparatus.

A mixture of the following components was prepared to obtain a coating composition for a reversible thermosensitive recording layer (amounts are in grams).

| | |
|---|---|
| Vinyl chloride-vinyl propionate copolymer (OS-430 made from Toso Co) | 3.9 |
| Dilauryl 1,18-octadecanedioate (Technical sample from Miyoshi Oil Co) | 0.475 |
| Eicosanedioic acid (SL-20-99 from Okamura Oil Co) | 0.525 |
| Tetrahydrofuran (Kanto Chemical Co) | 21.55 |
| n-pentyl alcohol (Tokyo Kasei Co) | 2.4 |

The composition prepared as above was coated on the light reflecting layer with a wire bar, and dried to form a reversible thermosensitive recording layer at 95° C. in contact with the side wall of a hot water bath. The recording layer was subsequently placed in a temperature controlled chamber at 130° C. for three minutes to form particles of organic material, thus obtaining a recording layer of 7.5 micron thick.

The following components were mixed to prepare a coating composition for a protective layer. 75% solution of urethane acrylate-based ultraviolet hardening resin (Unidic C7-157 from Japan Ink Co)

in butyl acetate 10

Isopropyl alcohol (Kanto Chemical Co) 10

The thus prepared solution was coated with a wire bar, dried, and then hardened under an ultraviolet lamp of 80 W/cm. The resulting reversible thermosensitive recording medium had the thickness of 2 microns and the recording medium was subsequently subjected to evaluation tests which is described below.

In addition, the rate of the change of transparency initiation temperature with heating time of vinyl-chloride-vinylpropionic acid copolymer used in the present process was found to be 1.7%.

Example 2

A reversible thermosensitive recording medium of the present invention was fabricated in accordance with steps and apparatus which follow.

On a supporting substrate of transparent polyethyleneterephthalate(PET)film of 188 micron thick (HSL-188 from Teijin Co), a layer of aluminum was deposited with a thickness of 600 A to form a light reflecting layer using a conventional vacuum evaporation apparatus.

A mixture of the following components was prepared to obtain a coating composition for a reversible thermosensitive recording layer.

| | |
|---|---|
| Vinyl chloride-vinyl propionate copolymer (OS-430 made from Tosoh Co) | 3.7 |
| Dilauryl 1,18-octadecanedioate (Technical sample from Miyoshi Oil Co) | 0.475 |
| Eicosanedioic acid (SL-20-99 from Okamura Oil Co) | 0.525 |
| Diisodecyl phthalate (Tokyo Kasei Co) | 0.3 |
| Sn salt of dibutylmethylcaptorate (JF-9B from Sankyo Organic Synthetic Co) | 0.11 |
| Trimethylpropane triacrylate (DPCA-30 from Nihon Kayaku Co) | 0.62 |
| Tetrahydrofuran (Kanto Chemical Co) | 21.55 |
| n-Pentyl alcohol (Tokyo Kasei Co) | 2.4 |

The composition prepared as above was coated on the light reflection layer with a wire bar, and dried to form a reversible thermosensitive recording layer at 95° C. in contact with the side wall of a hot water bath. The recording layer was subsequently placed in a temperature controlled chamber at 130° C. for 90 seconds to form particles of organic material, thus obtaining a recording layer with the thickness of 7.5 microns. The recording layer prepared as above was irradiated with electron beams with an electron beam irradiation apparatus of the area-type, Model EBC-200-AA2 by Nisshin High Voltage Co, under the following conditions:

| | |
|---|---|
| Acceleration voltage | 200 kV |
| Dose | 10 Mrad |
| Electron beam current | 43 mA |
| Conveyor speed | 10 m/min |

The following components were mixed to prepare a coating composition for a protective layer.

| | |
|---|---|
| 75% solution of urethane acrylate-based ultraviolet hardening resin (Unidic C7-157 from Japan Ink Co) in butyl acetate | 10 |
| Isopropyl alcohol (Kanto Chemical Co) | 10 |

On the recording layer, the thus prepared solution was coated with a wire bar, dried, and then hardened under a ultraviolet lamp of 80 W/cm. The resulting reversible thermosensitive recording medium had the thickness of 2 microns.

Example 3

A reversible thermosensitive recording medium was fabricated in a similar manner to Example 1, with the exception that heating the recording layer at 130° C. in the temperature controlled chamber was carried out for three minutes.

Example 4

A reversible thermosensitive recording medium was fabricated in a similar manner to Example 1, with the exception that heating the recording layer at 130° C. in the temperature controlled chamber was carried out for 6 minutes.

Comparative Example 1

A reversible thermosensitive recording medium was fabricated in a similar manner to Example 1, with the exception that heating the recording layer at 130° C. in the temperature controlled chamber was carried out for 20 seconds.

Comparative Example 2

A reversible thermosensitive recording medium was fabricated in a similar manner to Example 2, with the exception that no heating of the recording layer was carried out.

Comparative Example 3

A reversible thermosensitive recording medium was fabricated in a similar manner to Example 2, with the exception that heating the recording layer at 130° C. in the temperature controlled chamber was carried out for 20 seconds.

Comparative Example 4

A reversible thermosensitive recording medium was fabricated in a similar manner to Example 2, with the exception that heating the recording layer at 130° C. in the temperature controlled chamber was carried out for 40 seconds.

Comparative Example 5

A reversible thermosensitive recording medium of the present invention was fabricated in accordance with steps and apparatus which follow.

On a supporting substrate of transparent polyethyleneterephthalate(PET)film of 188 micron thick (HSL-188 from Teijin Co), a layer of aluminum was deposited with a thickness of 600 A to form a light reflecting layer using a conventional vacuum evaporation apparatus.

A mixture of the following components was prepared to obtain a coating composition for a reversible thermosensitive recording layer.

| | |
|---|---|
| Vinyl chloride-vinylacetate copolymer (M-2018 trom Kaneka Co) | 3.9 |
| Dilauryl 1, 18-octadecanedioate (Technical sample from Miyoshi Oil Co) | 0.475 |
| Eicosanedioic acid (SL-20-99 from Okamura Oil Co) | 0.525 |
| Tetrahydrofuran (Kanto Chemical Co) | 21.55 |
| n-Pentyl alcohol (Tokyo Kasei Co) | 2.4 |

The composition prepared as above was coated on the light reflecting layer with a wire bar, and dried to form a reversible thermosensitive recording layer at 95° C. in contact with the side wall of a hot water bath. The recording layer was subsequently placed in a temperature controlled chamber at 130° C. for three minutes to form particles of organic material, thus obtaining a recording layer of 7.5 micron thick.

The following components were mixed to prepare a coating composition for a protective layer.

| | |
|---|---|
| 75% solution of urethane acrylate-based ultraviolet hardening resin (Unidic C7-157 from Japan Ink Co) in butyl acetate | 10 |
| Isopropyl alcohol (Kanto Chemical Co) | 10 |

The thus prepared solution was coated with a wire bar, dried, and then hardened under an ultraviolet lamp of 80 W/cm. The resulting reversible thermosensitive recording medium had the thickness of 2 microns and the recording medium was subsequently subjected to evaluation tests which is described below.

In addition, the rate of the change of transparency initiation temperature with heating time of vinylchloride-vinylacetate copolymer used in the present process was found to be 14.9%.

The reversible thermosensitive recording media prepared as above from Example 1 through Comparative Example 5 were rendered to opaque state by heating at 135° C. on a hot plate and intensity values of scattered light were measured to obtain initial opaque densities with a McBeth reflectivity densitometer Model RD-918. Also similar measurements for these media were carried out after standing for one week at 35° C. The measurement results are shown in Table 1.

Figure 4:
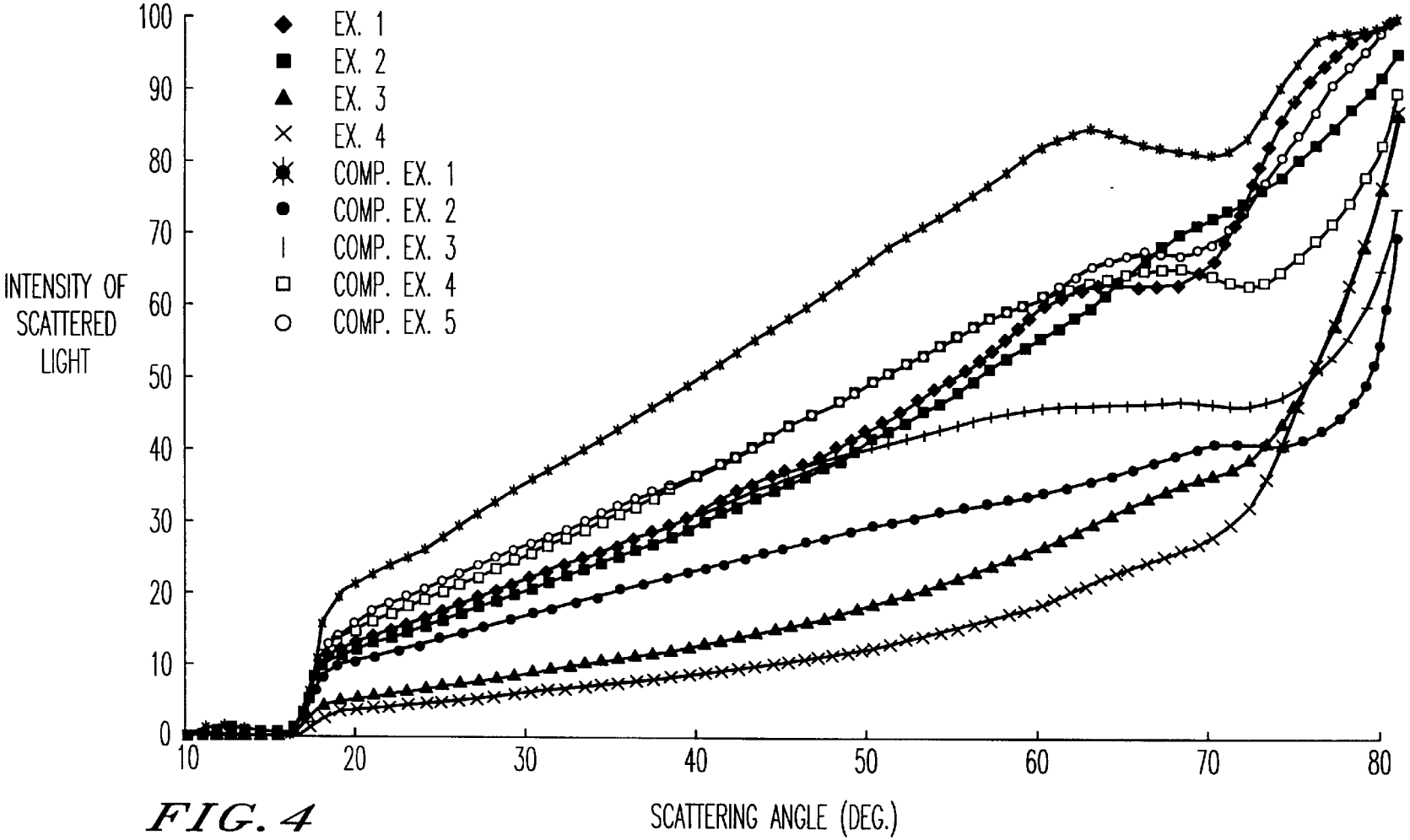
FIG. 4 is a graph showing the relationship between the scattered light intensity and the scattering angle for reversible thermosensitive recording media of the present invention.

Measurements of scattered light intensity were carried out in a similar manner as above for these media. The results are shown in Table 2 and FIG. 4.

By analyzing photographs by the transmission electron microscope, of cross sections of reversible thermosensitive recording layers in these media, the size and number of particles of low-molecular-weight organic material in the media were obtained. The results are shown in Tables 3 and 4.

TABLE 1

| | OD in initial opaque state | Color tone of whiteness | OD after one week at 35° C. | OD difference |
|---|---|---|---|---|
| EXAMPLE 1 | 0.30 | slightly yellowish | 0.40 | 0.10 |
| EXAMPLE 2 | 0.30 | slightly yellowish | 0.40 | 0.10 |
| EXAMPLE 3 | 0.31 | slightly yellowish | 0.40 | 0.09 |
| EXAMPLE 4 | 0.32 | slightly yellowish | 0.41 | 0.09 |
| COMPARATIVE EXAMPLE 1 | 0.34 | bluish | 0.55 | 0.21 |
| COMPARATIVE EXAMPLE 2 | 0.43 | bluish | 0.76 | 0.33 |
| COMPARATIVE EXAMPLE 3 | 0.37 | bluish | 0.56 | 0.19 |
| COMPARATIVE EXAMPLE 4 | 0.34 | bluish | 0.50 | 0.16 |
| COMPARATIVE EXAMPLE 5 | 0.30 | bluish | 0.35 | 0.05 |

TABLE 2

| | Average of light intensity values scattered from 40 degree to 50 | Average of light intensity values scattered from 70 degree to 80 | Ratio |
|---|---|---|---|
| EXAMPLE 1 | 37.49 | 86.05 | 2.30 |
| EXAMPLE 2 | 34.89 | 79.81 | 2.29 |
| EXAMPLE 3 | 15.50 | 48.35 | 3.12 |
| EXAMPLE 4 | 10.72 | 45.55 | 4.25 |
| COMPARATIVE EXAMPLE 1 | 58.38 | 91.48 | 1.57 |
| COMPARATIVE EXAMPLE 2 | 26.45 | 42.60 | 1.61 |
| COMPARATIVE EXAMPLE 3 | 35.43 | 50.04 | 1.41 |
| COMPARATIVE EXAMPLE 4 | 42.55 | 67.76 | 1.59 |
| COMPARATIVE EXAMPLE 5 | 41.21 | 80.30 | 1.95 |

TABLE 3

| | Number of particles of the size of 0.3 to 0.6 micron per unit area | Number of particles of the size of 1.0 micron or more per unit area | Ratio (%) |
|---|---|---|---|
| EXAMPLE 1 | 32 | 10 | 31.3 |
| EXAMPLE 2 | 44 | 1 | 2.2 |

TABLE 3-continued

| | Number of particles of the size of 0.3 to 0.6 micron per unit area | Number of particles of the size of 1.0 micron or more per unit area | Ratio (%) |
|---|---|---|---|
| EXAMPLE 3 | 30 | 7 | 23.0 |
| EXAMPLE 4 | 15 | 8 | 53.0 |
| COMPARATIVE EXAMPLE 1 | 61 | 1 | 1.7 |
| COMPARATIVE EXAMPLE 2 | 51 | 0 | 0 |
| COMPARATIVE EXAMPLE 3 | 78 | 0 | 0 |
| COMPARATIVE EXAMPLE 4 | 61 | 1 | 1.6 |
| COMPARATIVE EXAMPLE 5 | 66 | 0 | 0 |

TABLE 4

| | Number of particles of the size of 0.3 to 0.6 micron per unit area | Number of total particles per unit area | Ratio (%) |
|---|---|---|---|
| EXAMPLE 1 | 32 | 124 | 25.8 |
| EXAMPLE 2 | 44 | 159 | 27.3 |
| EXAMPLE 3 | 30 | 136 | 22.1 |
| EXAMPLE 4 | 15 | 97 | 15.5 |
| COMPARATIVE EXAMPLE 1 | 61 | 116 | 52.6 |
| COMPARATIVE EXAMPLE 2 | 51 | 112 | 45.5 |
| COMPARATIVE EXAMPLE 3 | 78 | 220 | 35.5 |
| COMPARATIVE EXAMPLE 4 | 61 | 114 | 53.5 |
| COMPARATIVE EXAMPLE 5 | 66 | 143 | 46.1 |

The results in the Tables 1 and 2 indicate that the reversible thermosensitive recording media obtained to have the ratio, of the two values of scattered light intensity at large angles and small angles, of two or more exhibit improved visual appearance and excellent durability in image display. The observations of, coloration and visual appearance of media were carried out visually.

The results in the Tables 1,3 and 4 indicate that, when the ratio, of the number of the particles with the large size to small size, as aforementioned, is preferably 2% or more and the ratio, of the number of the particles with the small size to the total number of the particles, preferably 10 or more, the reversible thermosensitive recording media presently obtained have characteristics such as opaqueness with better display quality and excellent image durability.

This application is based on Japanese Patent Application 07-206647, filed with the Japanese Patent Office on Jul. 19, 1995, the entire contents of which are hereby incorporated by reference.

Obviously, additional modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A reversible thermosensitive recording medium, comprising a supporting substrate and a reversible thermosensitive recording layer disposed thereon, said layer comprising a resin matrix and a low-molecular-weight organic material, said reversible thermosensitive recording layer having a ratio, of the two values of light intensity scattered by said recording layer at large angles and small angles, of more than or equal to two, wherein each of the light intensity values at large angles and small angles is obtained as the average of eleven intensity values measured by one degree intervals, from 70 degrees to 80 degrees of the scattering angle for the large angles and from 40 degrees to 50 degrees for the small angles, respectively, and where the scattering angle is the angle between the direction of the light detection and the direction parallel to the surface of said recording medium.

2. The reversible thermosensitive recording medium of claim 1, wherein said ratio of the two values of light intensity scattered by said reversible thermosensitive recording layer at large and small angles is more than or equal to three.

3. The reversible thermosensitive recording medium of claim 1, wherein said reversible thermosensitive recording medium has a rate of change in transparency initiation temperature with heating time of less than equal to 13%.

4. The reversible thermosensitive recording medium of claim 3, wherein said matrix resin in said reversible thermosensitive recording layer is formed as crosslinked resin.

5. The reversible thermosensitive recording medium of claim 1, wherein said matrix resin comprises at least one copolymer selected between copolymer of vinyl chloride and vinylester of fatty acid with three or more carbon atoms, and vinyl chloride-ethylene copolymer.

6. The reversible thermosensitive recording medium of claim 1, wherein said matrix resin in said reversible thermosensitive recording layer is formed as crosslinked resin.

7. The reversible thermosensitive recording medium of claim 1, further comprising a light reflecting layer disposed between said reversible thermosensitive recording layer and said supporting substrate.

8. The reversible thermosensitive recording medium of claim 1, further comprising a protective layer disposed on said reversible thermosensitive recording layer and on the outermost face of said reversible thermosensitive recording medium.

9. A reversible thermosensitive recording medium, comprising a supporting substrate and a reversible thermosensitive recording layer disposed thereon, said layer comprising a resin matrix and particles of a low-molecular-weight organic material said reversible thermosensitive recording layer having the ratio, of the two numbers of the particles of the low-molecular-weight organic material with specified large size and small size, of more than or equal to 0.02 and also has the ratio, of the two numbers of the particles of the specified small size and the total number or particles, of more than equal to 0.1, the specified large and small size being more than 1 micron and from 0.3 to 0.6 micron respectively.

10. The reversible thermosensitive recording medium of claim 9, wherein said ratio of the two values of said particles with specified large size and small size is more than or equal to 0.1.

11. The reversible thermosensitive recording medium of claim 9, wherein said reversible thermosensitive recording medium has the rate of change in transparency initiation temperature with heating time of less than equal to 13%.

12. The reversible thermosensitive recording medium of claim 11, wherein said matrix resin in said reversible thermosensitive recording layer is formed as crosslinked resin.

13. The reversible thermosensitive recording medium of claim 9, wherein said matrix resin comprises at least one copolymer selected between copolymer of vinyl chloride and vinylester of fatty acid with three or more carbon atoms, and vinyl chloride-ethylene copolymer.

14. The reversible thermosensitive recording medium of claim 9, wherein said matrix resin in said reversible thermosensitive recording layer is formed as crosslinked resin.

15. The reversible thermosensitive recording medium of claim 9, further comprising a light reflecting layer disposed between said reversible thermosensitive recording layer and said supporting substrate.

16. The reversible thermosensitive recording medium of claim 9, further comprising a protective layer disposed on said reversible thermosensitive recording layer and on the outermost face of said reversible thermosensitive recording medium.

17. A method of forming a reversible thermosensitive recording medium, comprising the steps of:

forming on a supporting substrate a reversible thermosensitive recording layer comprising a resin matrix and a low-molecular-weight organic material, said reversible thermosensitive recording layer having the ratio, of the two values of light intensity scattered by said recording layer at large angles and small angles, of more than or equal to three, wherein each of the light intensity values at large angles and small angles is obtained as the average of eleven intensity values measured by one degree intervals, from 70 degrees to 80 degrees of the scattering angle for the large angles and from 40 degrees to 50 degrees for the small angles, respectively, and where the scattering angle is the angle between the direction of the light detection and the direction parallel to the surface of said recording medium.

18. The method of claim 17, wherein said reversible thermosensitive recording medium has a rate of change in transparency initiation temperature with heating time length of less than equal to 13%.

19. The method of claim 17, wherein said matrix resin comprises at least one copolymer selected between copolymer of vinyl chloride and vinylester of fatty acid with three or more carbon atoms, and vinyl chloride-ethylene copolymer.

20. The method of claim 17, wherein said matrix resin in said reversible thermosensitive recording layer is formed as crosslinked resin.

21. The method of claim 17, wherein said reversible thermosensitive recording layer is heated to have storage modulus of more than or equal to $10^6$ Pa.

22. The method of claim 21, wherein said reversible thermosensitive recording layer is formed as crosslinked resin by being rendered to crosslinking following to a heat treatment.

23. The method of claim 17, further comprising a light reflecting layer disposed between said reversible thermosensitive recording layer and said supporting substrate.

24. The method of claim 17, further comprising a protective layer disposed on said reversible thermosensitive recording layer and on the outermost face of said reversible thermosensitive recording medium.

25. A method of forming a reversible thermosensitive recording medium, comprising the steps of:

forming on a supporting substrate a reversible thermosensitive recording layer comprising a resin matrix and particles of a low-molecular-weight organic material, said reversible thermosensitive recording layer having the ratio, of the two numbers of the particles of the low-molecular-weight organic material with specified large size and small size, of more than or equal to 0.02 and also has the ratio, of the two numbers of the particles of the specified small size and the total, of more than equal to 0.1, the specified large and small size being more than 1 micron and from 0.3 to 0.6 micron respectively.

26. The method of claim 25, wherein said reversible thermosensitive recording medium has a rate of change in transparency initiation temperature with heating time length of less than equal to 13%.

27. The method of claim 25, wherein said matrix resin comprises at least one copolymer selected between copolymer of vinyl chloride and vinylester of fatty acid with three or more carbon atoms, and vinyl chloride-ethylene copolymer.

28. The method of claim 25, wherein said matrix resin in said reversible thermosensitive recording layer is formed as crosslinked resin.

29. The method of claims 25, wherein said reversible thermosensitive recording layer is heated to have storage modulus of more than or equal to $10^6$ Pa.

30. The method of claim 29, wherein said reversible thermosensitive recording layer is formed as crosslinked resin by being rendered to crosslinking following to a heat treatment.

31. The method of claim 25, further comprising a light reflecting layer disposed between said reversible thermosensitive recording layer and said supporting substrate.

32. The method of claim 25, further comprising a protective layer disposed on said reversible thermosensitive recording layer and on the outermost face of said reversible thermosensitive recording medium.

* * * * *

UNITED STATES PATENT AND TRADEMARK OFFICE

CERTIFICATE OF CORRECTION

PATENT NO. : 5,869,422

DATED : February 9, 1999

INVENTOR(S) : Kazumi Suzuki, et. al.

It is certified that error appears in the above-identified patent and that said Letters Patent is hereby corrected as shown below:

On the Title page, item [19] change Kazumi, et. al. to -- Suzuki, et. al.
item [75] should read--Kazumi Suzuki--

Signed and Sealed this

Fourteenth Day of December, 1999

*Attest:*

*Attesting Officer*

Q. TODD DICKINSON

*Acting Commissioner of Patents and Trademarks*